US009907334B2

(12) United States Patent
Sieredzinski et al.

(10) Patent No.: US 9,907,334 B2
(45) Date of Patent: Mar. 6, 2018

(54) METHOD AND DEVICE FOR OPENING CIGARETTES CONSTITUTING CIGARETTE WASTE

(75) Inventors: Marek Sieredzinski, Radom (PL); Wojciech Janczyk, Kowala (PL)

(73) Assignee: International Tobacco Machinery Poland Sp. Z O.O., Radom (PL)

( * ) Notice: Subject to any disclaimer, the term of this patent is extended or adjusted under 35 U.S.C. 154(b) by 1238 days.

(21) Appl. No.: 14/000,039

(22) PCT Filed: Feb. 15, 2012

(86) PCT No.: PCT/PL2012/050006
§ 371 (c)(1),
(2), (4) Date: Aug. 16, 2013

(87) PCT Pub. No.: WO2012/112062
PCT Pub. Date: Aug. 23, 2012

(65) Prior Publication Data

US 2013/0319433 A1 Dec. 5, 2013

(30) Foreign Application Priority Data

Feb. 16, 2011 (PL) ..... 393944

(51) Int. Cl.
*A24C 5/36* (2006.01)

(52) U.S. Cl.
CPC ..... *A24C 5/36* (2013.01)

(58) Field of Classification Search
CPC ..... A24C 5/36
USPC ..... 131/281, 96
See application file for complete search history.

(56) References Cited

U.S. PATENT DOCUMENTS 5,425,384 A * 6/1995 White ..... A24B 3/04 131/290

FOREIGN PATENT DOCUMENTS

| | | | |
|---|---|---|---|
| CN | 23565503 | Y | 1/2000 |
| DE | 567059 | C | 12/1932 |
| DE | 1632241 | U | 12/1951 |
| EP | 0170731 | A1 | 2/1986 |
| EP | 2206585 | B1 | 12/2011 |

(Continued)

OTHER PUBLICATIONS

Notice of reasons for rejection, dated Jun. 23, 2015, in corresponding application No. 2013554414.

(Continued)

*Primary Examiner* — Michael H. Wilson
*Assistant Examiner* — Yana B Krinker
(74) *Attorney, Agent, or Firm* — Browdy and Neimark, PLLC

(57) ABSTRACT

A method for opening cigarettes constituting cigarette waste in a device comprising a rotational drum (1) the inner wall of which is provided with at least one scraping away element (2, 2', 2") extending generally along the drum, and at least one rotational beater (4, 4', 4") located inside the drum (1) striking against the cigarettes, wherein the cigarettes fed into the rotating drum (1) and being lifted by means of at the least one scraping away element (2, 2', 2") and falling by gravity, are struck against by means of the at least one rotational beater (4, 4', 4") in a direction substantially perpendicular to the axes of the cigarettes with a force enabling their opening. A device for realization of the method of the invention.

12 Claims, 3 Drawing Sheets

(56) References Cited

FOREIGN PATENT DOCUMENTS

| | | | |
|---|---|---|---|
| GB | 191309696 | A | 9/1913 |
| GB | 327765 | A | 4/1930 |
| GB | 379799 | A | 9/1932 |
| GB | 911343 | A | 6/1954 |
| GB | 1103929 | A | 2/1968 |
| GB | 1249541 | A | 10/1971 |
| JP | 465040 | | 2/1971 |
| JP | 48035099 | | 5/1973 |
| JP | 52038519 | | 3/1977 |
| JP | S57115172 | A | 7/1982 |
| JP | 60137270 | A | 7/1985 |
| JP | 2004313051 | A2 | 11/2004 |
| JP | 2005168361 | A2 | 6/2005 |
| PL | 303858 | A1 | 9/1995 |
| RU | 2100944 | C1 | 1/1998 |
| SU | 348198 | A1 | 12/1972 |

OTHER PUBLICATIONS

English translation of Official action dated Feb. 28, 2015, in corresponding Chinese appl. No. 20128009154.6.

* cited by examiner

METHOD AND DEVICE FOR OPENING CIGARETTES CONSTITUTING CIGARETTE WASTE

The object of the invention is a method and a device for opening cigarettes constituting cigarette waste rejected from the process of production and packaging of cigarettes.

An important issue related to a cigarette production process is reclaiming tobacco from the cigarettes constituting the production process waste generated during start-up of machines for production and packaging of cigarettes. The cigarette waste is constituted by finished cigarettes which do not meet quality requirements. The cigarette waste may also include the cigarettes meeting the quality requirements but packed into defective packs. The tobacco reclaimed from the waste cigarettes is reused in the production process. An initial step of the tobacco recycling process is opening the waste cigarettes which can be preceded for example by perforating or cutting the cigarette paper wrappers. In the case of cutting non-filter cigarettes, the cigarette paper wrapper is cut along the whole length of a cigarette. In the case of filter cigarettes, the paper wrapper should only be cut along the tobacco portion, while in the filter portion the paper wrapping the filter must remain unimpaired. The reclaimed tobacco is added to the shredded tobacco which is fed to the machines for the production of cigarettes. Since the smoke from burnt filtering material can be harmful to smokers, quality of the cigarettes is significantly lowered if the tobacco used for the production comprises particles of filtering material. While designing devices for reclaiming tobacco from the defective cigarettes it has to be taken into account that contemporarily produced cigarettes are provided with more and more complex, and thus increasingly longer, multi-segment filters comprising various kinds of filtering materials and flavour additives. Individual components of the multi-segment filters are not bonded with one another so the filter structure is protected only by the paper wrapper of the filter, which makes the multi-segment filters particularly sensitive to accidental local impacts causing their breakage or deformation. Additional weakness of such filters is caused by the spaces which are not filled or which are only partially filled with for example carbonaceous granulate, these spaces being located between hard filter segments.

Document GB 327 765 presents a cylindrical rotating drum sieve, into which the cut open cigarettes are fed in order to separate the shredded tobacco from the tobacco paper. Bars are provided inside the drum along its generatrices designed to move the defective cigarettes upwardly so as to make them fall from a substantial height onto the lower part of the sieve. The cigarettes fed into the drum having an inclined axis of rotation are repeatedly lifted and deformed while dropping down onto the lower part of the sieve on their way from the drum inlet to the outlet thereof. This process enables reclaiming tobacco from the cigarettes.

Document DE 567 059 discloses a prism-shaped rotational drum sieve. The cigarettes fed into the drum repeatedly strike against the drum walls while also coming under the action of non-moving elements which press them against the drum walls, which enhances extraction of tobacco from the cigarettes. Similarly to the solution presented in the previous document, the axis of rotation of the sieve is inclined.

Document DE 1 632 241 presents various apparatuses for opening cigarettes provided with many cigarette striking elements. The cigarettes moving through the drum chambers are repeatedly struck, deformed and broken. It should be noted that the cigarettes being struck at random due to the presence of numerous striking elements. The spaces between the working elements are chosen so as to prevent tearing the paper wrapper apart so as the filters are not impaired during tobacco extraction. However, this solution is not applicable in the case of the contemporarily used long multi-segment filters because it would lead to breakage of such filters causing extraction of the filter segments or filtering materials.

The object of the invention is to provide an improved method and a device for opening cigarettes constituting cigarette waste, which would eliminate the possibility of the cigarettes being struck against at random. Another object of the invention is to provide a new device which is more efficient than the known devices of that type, while keeping its dimensions relatively small.

According to the invention a method is provided for opening cigarettes constituting cigarette waste in a device comprising a rotational drum the inner wall of which is equipped with at least one scraping away element extending generally along the drum, and at least one rotational beater located inside the drum striking against the cigarettes, wherein the cigarettes fed into the rotating drum and being lifted by means of at the least one scraping away element and falling by gravity, are struck against by means of the at least one rotational beater in a direction substantially perpendicular to the axes of the cigarettes with a force enabling their opening.

Preferably, the cigarettes are struck against along their whole length.

Each beater preferably rotates in the same direction as the drum or in a direction opposite to the direction of rotation of the drum.

Preferably, the cigarettes are cut or perforated before being fed into the drum.

According to the invention a device is provided for opening cigarettes constituting cigarette waste, comprising a rotational drum having a rotation axis inclined to the horizontal, the inner wall of which being provided with at least one scraping away element extending substantially along the drum, with at least one rotational rod-shaped beater striking against the cigarettes located inside the drum.

The device is characterised in that the said at least one beater is pivotally mounted on an axis directed along the axis of the drum and is rotatable in a space between the axis of the drum and the at least one scraping away element in such a way that each beater is oriented substantially along the drum.

Preferably, the said at least one beater extends substantially along the at least one scraping away element.

The axis of rotation of the at least one beater is preferably parallel to the axis of the drum but is not aligned with the said axis.

Two beaters may be mounted opposite to each other in relation to their axis of rotation.

The device preferably comprises two or four scraping away elements arranged in pairs opposite to each other in relation to the axis of the drum.

The at least one beater may have a form of a rod oriented in parallel to the axis of the drum.

In a variant, the at least one beater may have a form of a rod having a diameter corresponding to the cigarette diameter.

In another variant the at least one beater has a form of a rod having a rectangular cross section.

Preferably, the device may comprise a rotatable cylindrical surface limiting the working space of the beaters from the inside, the surface being located between the at least one beater and the axis of the drum, the axis of rotation of the surface being preferably aligned with the axis of rotation of the beaters.

The cylindrical surface is preferably extended at one side by a conical surface.

The distance between the cylindrical surface and the scraping away element may correspond to three diameters of a cigarette, preferably two diameters of the cigarette.

The at least one scraping away element preferably protrudes radially or in a non-radial direction inward from the inner wall of the drum.

The at least one scraping away element is preferably oriented obliquely to the drum axis.

In the device according to the invention, the opening of the cigarettes is performed within a small space while the device is highly efficient.

Owing to the special construction of the device and to the orientation of the beaters along the drum as well as the orientation of the cigarettes along the scraping away elements, the cigarettes may be struck against over its entire length in a direction perpendicular to the axes of the cigarettes. Such an arrangement reduces the risk of damaging the filter possibly leading to extraction of filtering material, in particular the segments of multi-segment filters comprising untypical filtering elements and flavour additives. Striking by the working surface of the beater against the filter in a direction perpendicular to the filter axis does not result in separation of the filter components because there are no forces which could make the filter segments move apart or make the filter break.

The device operates efficiently enough to enable opening of the cigarettes that have not been perforated before.

The preferred embodiments of the device according to the invention are presented in a drawing, wherein.

Figure 1:
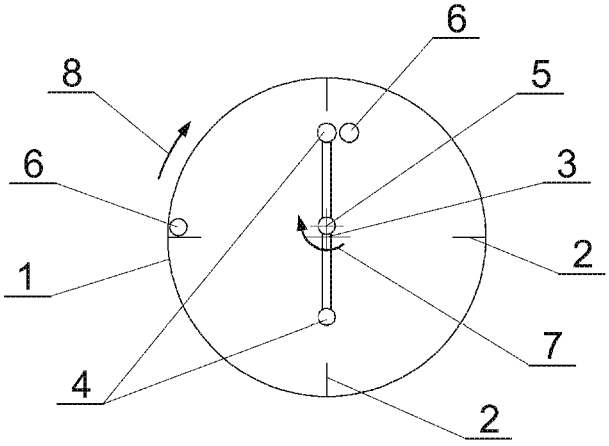
FIG. 1 shows a cross-sectional view of the device in the first embodiment of the invention.

The device according to the first embodiment of the invention consists of a cylindrical rotational drum 1 (FIG. 1, FIG. 2), to the inside wall of which partition-type scraping away elements 2 are fitted extending substantially along the drum 1. The cylindrical drum 1 is pivotally mounted on the axis 3, the axis 3 of the drum 1 being inclined to the horizontal plane. Inside the drum 1, the device is provided with at least one rotational beater 4, rotating around the axis 5 oriented in parallel to the rotation axis 3 of the drum 1. For the purpose of simplification, conventional driving elements rotating the drum 1 and the beaters 4 are not shown in the drawing.

Figure 2:
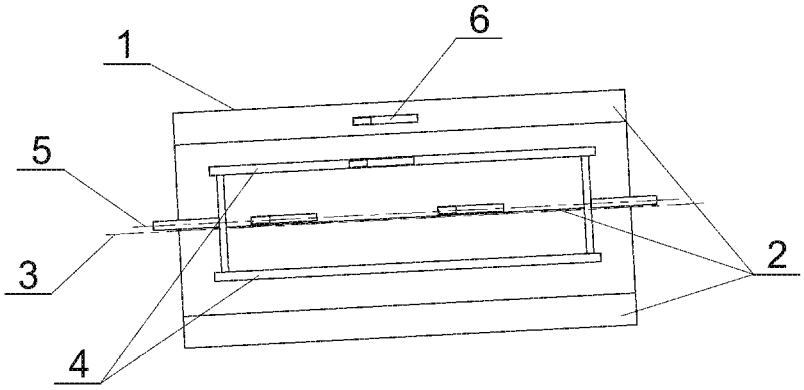
FIG. 2 shows a longitudinal section of the device from FIG. 1.

The cigarettes 6 are delivered to the open space of the drum 1 on the side of this end of the drum which is located higher (on the right side in FIG. 2). While the drum 1 is rotating the cigarettes are repeatedly lifted by the scraping away elements 2 which cause the cigarettes 6 to move along the drum 1 (to the left side in FIG. 2) due to the inclination of the axis 3 of the drum 1. The scraping away elements 2 have a width adapted to the diameter of the cigarettes being opened, preferably to the diameter of a typical cigarette, i.e. of approx. 8 mm. The scraping away elements 2 may have a form of a slat type thin-walled elements, e.g. metal sheet elements. The cigarettes 6, which are lifted by the scraping away elements 2 slide down from them when the scraping away elements 2 reach the upper part of the drum 1. FIG. 1 shows a device provided with four evenly spaced scraping away elements 2 protruding radially from the inner side of the drum in the direction toward the drum axis. Embodiments with other numbers of the elements 2 are also possible, although one scraping away element 2 is sufficient to ensure correct operation of the device. The device shown in FIG. 1 is provided with two rod type beaters 4 having a circular cross-section, situated in parallel to the scraping away elements 2, rotating around the axis 5 arranged in parallel to the axis 3 of the drum 1. During the operation of the device the beaters 4 rotate in the space between the axis 3 of the drum 1 and the wall of the drum 1 striking against the cigarettes sliding down from the scraping away elements 2. The cigarettes 6, when slipping off the scraping away elements, are oriented substantially along the scraping away element and along the drum, hence they are struck against perpendicularly to their axes, mostly along their entire length. The area of the contact of the cylindrical rod type beater with a cigarette which is also cylindrical, extends along the cigarette length. The device in the first embodiment in FIGS. 1 and 2 is provided with two beaters, however one beater 4 is sufficient to ensure correct operation. In this embodiment, the beaters 4 rotate in the direction indicated by the arrow 7 concurrently with the direction of rotation of the drum 1, indicated by the arrow 8, the rotational speed of the beaters 4 being higher than the rotational speed of the drum 1. The force with which the beater 4 strikes against the cigarette 6 causes temporary deformation of the cigarette. In the case of striking against a cigarette having its paper wrapper cut or perforated, the cigarette deformation causes the paper wrapper to tear. In the case of the cigarettes, the paper wrapper of which has been neither cut nor perforated, multiple strikes and deformation of the cigarettes while passing through the device will result in loosening the tobacco inside the cigarette and will enforce ejection of the tobacco outside the cigarette in course of the subsequent strikes. An embodiment in which the beaters 4 and the drum 1 rotate in opposite directions is also possible.

Figure 3:
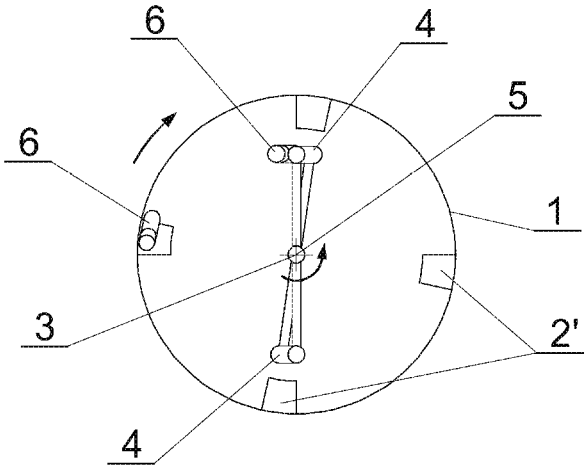
FIG. 3 shows a cross-sectional view of the device in the second embodiment.
Figure 4:
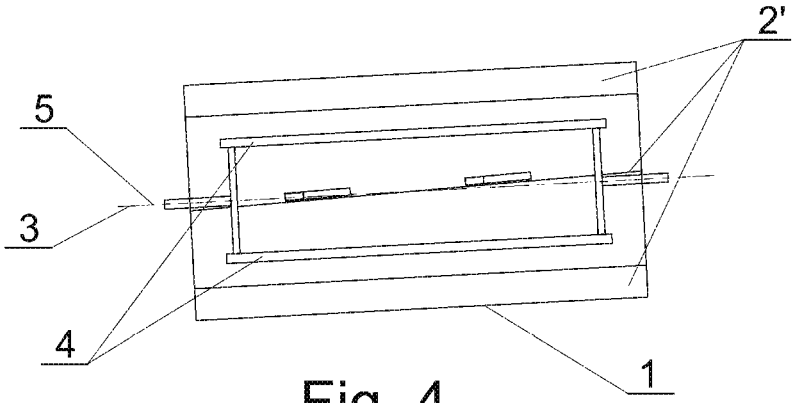
FIG. 4 shows a longitudinal section of the device from FIG. 3.

FIG. 3 and FIG. 4 show a second embodiment of the device in which the scraping away elements 2' are placed substantially along the drum but obliquely against its axes and generatrices. The scraping away elements 2' are therefore slightly curved in this embodiment, the curve being invisible in FIG. 4 due to its scale. In this embodiment, the rotation axis 5 of the beaters 4 is aligned with the axis 3 of rotation of the drum 1, while the drum 1 and the beaters 4 rotate in opposite directions; the beaters 4 extend substantially along the scraping away elements, in fact, they are also slightly curved, similarly to the scraping away elements 2'.

Figure 5:
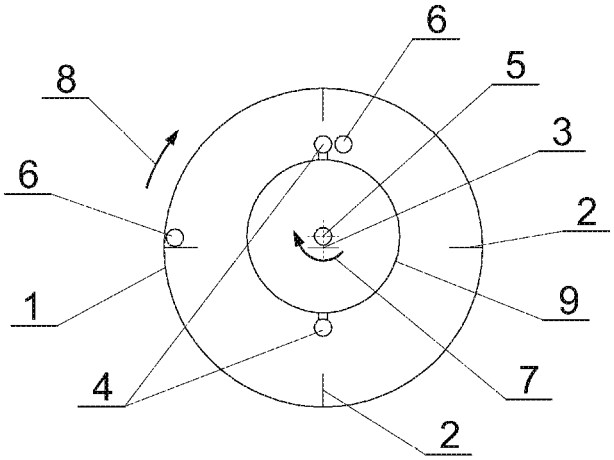
FIG. 5 shows a cross-sectional view of the device in the third embodiment.
Figure 6:
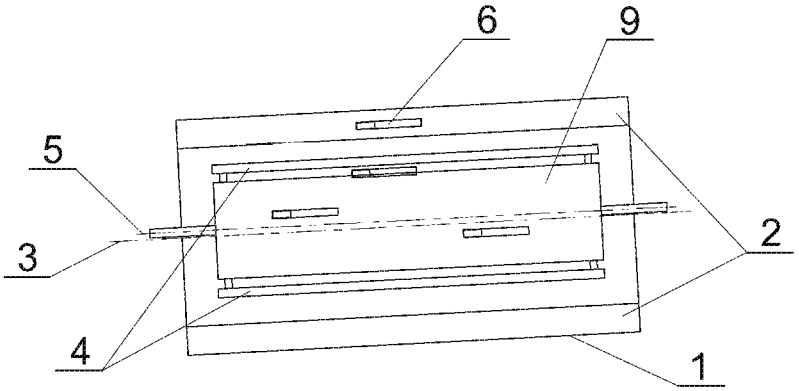
FIG. 6 shows a cross-sectional view of the device from FIG. 5.

FIG. 5 and FIG. 6 show a third embodiment of the device in which the device is provided with a cylindrical surface 9 rotating together with the beaters 4 around an axis 10 extending in parallel to the rotation axis 5 of the beaters 4; the axis 10 does not need to be aligned with the axis 3 of the drum and the length of the cylindrical surface corresponds to the length of the beaters. Preferably, the rotation axis 10 of the cylindrical surface 9 is aligned with the axis 5 of rotation of the beaters 4. The diameter of the cylindrical surface is adjusted so as to ensure that the distance between the scraping away element 2 and the cylindrical surface in the upper part of the drum 1 in FIG. 5 does not exceed three diameters of the cigarette. The distance between the scraping away element and the cylindrical surface can be reduced to two diameters of the cigarette. In this embodiment, during the operation of the device the cigarettes move in the cylindrical space limited by two cylindrical surfaces: the outer surface of the drum 1 and the inner cylindrical surface 9. Due to the small distance between the two cylindrical surfaces, the cigarettes cannot take an orientation that is e.g. a radial in relation to the rotation axis 3 of the drum 1; they can only be positioned along the drum 1. Provision of the cylindrical surface 9 in the device ensures that the cigarettes 6 sliding down from the scraping away elements 2 cannot set themselves obliquely before being struck against by the beaters 4 and will be struck against by the beaters 4 substantially perpendicularly to their axes.

Figure 7:
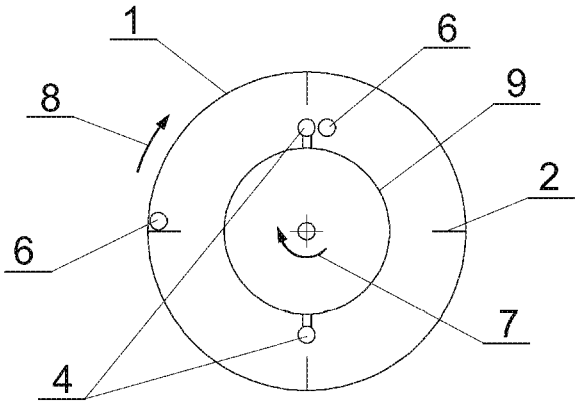
FIG. 7 shows a cross-sectional view of the device in the fourth embodiment.
Figure 8:
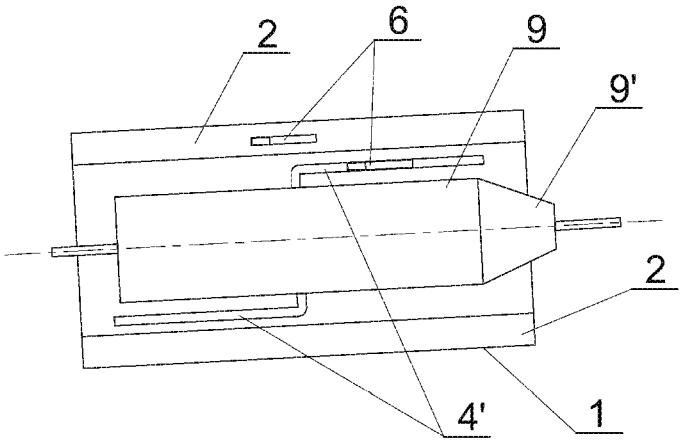
FIG. 8 shows a cross-sectional view of the device from FIG. 7.

FIG. 7 and FIG. 8 show the fourth embodiment of the device, also provided with the cylindrical surface 9 rotating along with the beaters 4' around the axis 10 which is aligned with the axis 5 of rotation of the beaters 4. In this embodiment, the device is provided with two beaters, each of them having its length close to the half of the length of the drum, the beaters being arranged on the opposite sides of their axis of rotation, one of them extending from the centre of the drum towards its one end and the other extending from the centre of the drum towards its other end. Furthermore, the cylindrical surface 9 is extended on its side close to the higher end of the drum 1 by a frusto-conical surface 9'. In this embodiment, the frusto-conical surface 9' facilitates introducing the cigarettes 6 into the space limited by the outer surface of the drum 1 and by the inner cylindrical surface 9 described in the previous embodiment.

Figure 9:
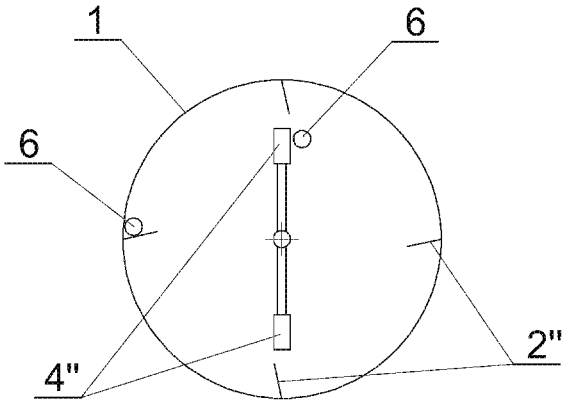
FIG. 9 shows a cross-sectional view of the device in the fifth embodiment.

FIG. 9 shows the fifth embodiment of the device, in which the scraping away elements 2" are arranged along the drum 1, but they protrude from the inner surface of the drum in the direction deflected from the radial direction. The beaters 4" have a form of rods of a rectangular cross section and hence the cigarettes 6 are struck against with a flat surface of the beaters 4" which ensures linear contact of the beater 4" with a cigarette 6 even if the cigarette slides down from the scraping away element 2" not in parallel to the axis 3 of the drum 1.

The invention claimed is:

1. A method of opening cigarettes constituting cigarette waste in a device comprising a drum configured to rotate about a rotation axis inclined with respect to a horizontal direction, at least one scraping away element disposed on an inner wall of the rotational drum, each at least one scraping away element having a longitudinal axis that extends generally along a longitudinal axis of the drum, at least one rotational rod-shaped beater located inside the drum and configured and disposed so as to strike against the cigarettes located inside the drum, and a rotatable cylindrical surface limiting a working space of the beaters inside the drum, the rotatable cylindrical surface being located between the at least one beater and the longitudinal axis of the drum, the axis of rotation of the rotatable cylindrical surface being aligned with the axis of rotation of the beaters, wherein said at least one beater is pivotally mounted on an axis of rotation directed along the longitudinal axis of the drum and is rotatable in a space between the longitudinal axis of the drum and the at least one scraping away element in such a way that each beater is oriented substantially along the longitudinal axis of the drum, the method comprising:

feeding the cigarettes into the drum, causing the drum to rotate about the rotation axis, lifting the cigarettes, by at the least one scraping away element and so that the cigarettes fall within the drum by gravity, and are thus struck by the at least one rotational beater in a direction substantially perpendicular to longitudinal axes of the cigarettes with a force sufficient to open the cigarettes.

2. The method according to claim 1, wherein the cigarettes are struck against along their whole length.

3. The method according to claim 1, wherein each beater rotates in the same direction as the drum.

4. The method according to claim 1, wherein each beater rotates in a direction opposite to the direction of rotation of the drum.

5. The method according to claim 1, wherein the cigarettes are cut or perforated before being fed into the drum.

6. A device for opening cigarettes constituting cigarette waste, comprising:

a drum configured to rotate about a rotation axis inclined with respect to a horizontal direction, at least one scraping away element disposed on an inner wall of the rotational drum and extending substantially along a longitudinal axis of the drum, at least one rotational rod-shaped beater located inside the drum and configured and disposed so as to strike against the cigarettes located inside the drum, and a rotatable cylindrical surface limiting a working space of the beaters inside the drum, the rotatable cylindrical surface being located between the at least one beater and the longitudinal axis of the drum, the axis of rotation of the rotatable cylindrical surface being aligned with the axis of rotation of the beaters, wherein said at least one beater is pivotally mounted on an axis of rotation directed along the longitudinal axis of the drum and is rotatable in a space between the longitudinal axis of the drum and the at least one scraping away element in such a way that each beater is oriented substantially along the longitudinal axis of the drum.

7. The device according to claim 6, wherein the rotatable cylindrical surface is extended at one side by a frusto-conical surface.

8. The device according to claim 6, wherein a distance between the rotatable cylindrical surface and the scraping away element corresponds to at least two diameters of a cigarette.

9. The device according to claim 6, wherein the at least one scraping away element protrudes radially inward from the inner wall of the drum.

10. The device according to claim 6, wherein at the least one scraping away element protrudes inward from the inner wall of the drum in a non-radial direction.

11. The device according to claim 6, wherein the at least one scraping away element is oriented obliquely to the longitudinal axis of the drum.

12. The device according to claim 6, wherein a distance between the cylindrical surface and the scraping away element corresponds to three diameters of a cigarette.

* * * * *